United States Patent [19]

Shibata et al.

[11] Patent Number: 4,773,947

[45] Date of Patent: Sep. 27, 1988

[54] MANUFACTURING PROCESS FOR HIGH TEMPERATURE CARBURIZED CASE HARDEN STEEL

[75] Inventors: Kimihiro Shibata, Yokosuka; Masahide Ike, Yokohama; Kenji Isokawa, Aichi Prefecture; Katsunori Takada, Nagoya, all of Japan

[73] Assignees: Nissan Motor Co., Ltd.; Daido Tokushuko Kabushiki Kaisha, both of Japan

[21] Appl. No.: 751,465

[22] Filed: Jul. 3, 1985

Related U.S. Application Data

[63] Continuation of Ser. No. 635,062, Jul. 27, 1984, abandoned.

[30] Foreign Application Priority Data

Aug. 2, 1983 [JP] Japan ..... 58-140528

[51] Int. Cl.[4] ..... C21D 9/00

[52] U.S. Cl. ..... 148/16.5; 148/319

[58] Field of Search ..... 148/36, 16.5, 16.6, 148/31.5, 12 R, 12 F, 136, 319; 75/123 J, 126 E, 126 Q, 123 AA, 123 L, 128 C, 128 V

[56] References Cited

U.S. PATENT DOCUMENTS

| | | | |
|---|---|---|---|
| 3,661,656 | 5/1972 | Jarleborg | 148/36 |
| 3,897,618 | 8/1975 | Church | 419/23 |
| 4,119,443 | 10/1978 | Abe et al. | 148/15.5 |
| 4,157,258 | 6/1979 | Philip et al. | 148/36 |
| 4,358,317 | 11/1982 | Abe | 148/36 |

FOREIGN PATENT DOCUMENTS

| | | | |
|---|---|---|---|
| 46-15212 | 4/1971 | Japan | 148/36 |
| 9326 | 1/1981 | Japan | 148/12 F |
| 60053 | 4/1982 | Japan | 148/12 F |
| 136717 | 8/1983 | Japan | 148/12 F |
| 59-232252 | 12/1984 | Japan | 148/36 |
| 696883 | 9/1953 | United Kingdom . | |

OTHER PUBLICATIONS

Cuddy et al., *Metallurgical Transactions A*, "Austenite Grain Coarsening in Microalloyed Steels", vol. 14A, Oct. 1983, pp. 1989–1995.

T. Gladman, et al., *Journal of the Iron and Steel Institute*, "Grain-Coarsening of Austenite", Jun. 1967, pp. 653–664.

*Primary Examiner*—Deborah Yee

*Attorney, Agent, or Firm*—Foley & Lardner, Schwartz, Jeffery, Schwaab, Mack, Blumenthal & Evans

[57] ABSTRACT

A case hardening steel which consists essentially of 0.03–0.2 wt % of C, 1.0–3.0 wt % of Si, 0.2–2.0 wt % of Mn, 0.05–0.5 wt % of V and the balance of Fe. The primary advantage of this steel is fineness of grain size after carburizing at relatively high temperatures. Even when carburizeed at or above 950° C., the grain size number is not smaller than 6 in both the hardened case and the core. Optionally the steel may contain up to 2.0 wt % of Ni, up to 2.0 wt % of Cr and/or up to 0.5 wt % of Mo for the reinforcing purpose, and/or up to 0.1 wt % of Al, up to 0.3 wt % of Ti, up to 0.1 wt % of Zr, up to 0.03 wt % of N and/or up to 0.5 wt % of Nb+Ta for the purpose of depressing the grain growth.

2 Claims, No Drawings

MANUFACTURING PROCESS FOR HIGH TEMPERATURE CARBURIZED CASE HARDEN STEEL

This application is a continuation of application Ser. No. 635,062, filed July 27, 1984, now abandoned.

BACKGROUND OF THE INVENTION

This invention relates to a case hardening steel which is suitable for carburizing of relatively high temperatures.

The power trains in transportation machines represented by automobiles, other industrial machines or agricultural machines include various structural machine parts such as gears, bearings and shafts. In general machine structural carbon steels or alloy steels are employed as the material of such structural machine parts, and in many cases the machine parts fabricated by a suitable forming method are subjected to a surface hardening treatment such as gas carburizing or carbonitriding.

Conventional surface hardening treatments for this purpose are commonly carried out at temperatures below 950° C. and consume a very long time to accomplish carburizing or carbonitriding to a required depth. Therefore, the surface hardening treatment has offered an obstacle to the enhancement of the productivity of the aforementioned machine parts.

With such a technological background, a vacuum carburizing method has been developed as one of recent carburizing techniques which are expected to enable to accomplish sufficient carburizing in a fairly short time. In general the vacuum carburizing treatment is carried out at relatively high temperatures and usually at temperatures above 950° C.

However, the employment of higher temperatures in carburizing has offered new problems to the industrial production of the machine parts. When structural machine parts formed of a conventional machine structural carbon steel, which is usually a so-called case hardening steel, are subjected to the high temperature vacuum carburizing treatment, the high temperature of the treatment is liable to cause coarsening of the grain size of the treated steel so that the machine parts are liable to suffer from a great thermal strain or significant lowering in mechanical strength. As a countermeasure, it is usual to carry out a so-called grain refining treatment subsequently to the vacuum carburizing treatment. That is, the carburized machine parts are once cooled to a temperature below the transformation temperature and again heated up to the austenizing temperature and then quenched. However, the addition of the cooling and reheating process to the vacuum carburizing treatment means a considerable increase in the length of time required for accomplishment of the surface hardening, so that the total operation time does not become so short as expected compared with the conventional gas carburizing treatment. This is a major reason for the slowness of industrial popularization of the vacuum carburizing method which is advantageous in respect of the carburizing efficiency.

To solve the above described problems in the vacuum carburizing method it has been tried to develop a new steel which possesses an austenite-ferrite two-phase structure at the high temperatures employed in carburizing. However, the results have not been fruitful. Thus far, the researches have attained some success in grain refining of the core portion of a carburized steel body, but grain refining of the hardened case portion is still difficult.

SUMMARY OF THE INVENTION

It is an object of the present invention to provide a novel case hardening steel, which is suitable for carburizing at relatively high temperatures as employed in the vacuum carburizing method and, when carburized in the form of a machine part, possesses a sufficiently fine grain size structure not only in the core but also in the hardened case of the machine part even though carburizing is performed at a temperature above 950° C.

The present invention provides a case hardening steel which consists of 0.03 to 0.2 wt. % of C, 1.0 to 3.0 wt. % of Si, 0.2 to 2.0 wt. % of Mn, 0.05 to 0.5 wt. % of V and the balance of Fe and inevitable impurities.

Furthermore, it is within the scope of the invention to replace a part of Fe in the above specified steel composition by at least one auxiliary alloying element. More definitely, a case hardening steel according to the invention may optionally contain, besides the above specified essential alloying elements, not more than 2.0 wt. % of Ni, not more than 2.0 wt. % of Cr and/or not more than 0.5 wt. % of Mo as a matrix reinforcing component, and/or not more than 0.1 wt. % of Al, not more than 0.3 wt. % of Ti, not more than 0.1 wt. % of Zr, not more than 0.03 wt. % of N, not more than 0.5 wt. % of Nb and/or not more than 0.5 wt. % of Ta, on condition that the total of Nb and Ta is not more than 0.5 wt. %, as a grain growth depressing component.

A case hardening steel according to the invention is suitable as the material of various structural machine parts which are subjected to carburizing treatment for the purpose of surface hardening. The primary advantage of this case hardening steel resides in that the grain size after the carburizing treatment is sufficiently and uniformly fine. Even when the carburizing treatment is performed at a temperature higher than 950° C., the surface hardening is not accompanied by coarsening of the austenite grain size. More particularly, in a machine part which is formed of a case hardening steel according to the invention and subjected to a carburizing treatment, the grain size number is not smaller than Number 6 (according to ASTM) in both the core and the hardened case of the metal part even when the carburizing temperature is above 950° C.

Therefore, surface hardening of structural machine parts formed of a case hardening steel according to the invention can be done by a vacuum carburizing method which employs a carburizing temperature above 950° C. In this case there is no need to perform a grain refining treatment subsequent to the carburizing treatment since the machine parts in the as-carburized state possess a fine grain structure not only in the core but also in the case. Consequently the surface hardening of the machine parts can be accomplished in a fairly short time, and the obtained machine parts are high in dimensional precision and excellent in strength, toughness, durability and fatigue strength. In the automobile industry, for example, a case hardening steel according to the invention is useful as the material of various structural machine parts such as gears, ball joints, drive shafts, cam shafts, steering parts, bearings and bearing races.

In addition to or independently of the optional alloying elements described hereinbefore, Cu may be added to the fundamental steel composition according to the invention for the purpose of enhancing weatherability, and Pb, S, Te, Bi, Se and/or Ca for the purpose of improving machinability or some other properties.

In producing a case hardening steel according to the invention, there is no need to particularly modify the popular methods for producing conventional case hardening steels.

DESCRIPTION OF THE PREFERRED EMBODIMENTS

A case hardening steel according to the invention has the composition specified above. The effects of the essential and optional alloying elements and the reasons for the limitations on the amounts of the respective alloying elements are as follows. Throughout the following description, the amounts of the elements in the steel composition are given in percentages by weight.

(1) Carbon

C is an alloying element indispensable to a case hardening steel. Owing to the presence of C, the steel possesses mechanical strength sufficient to serve as a structural material and high hardness of the surface after the carburizing treatment. Furthermore, the presence of C is essential for the formation of an austenite-ferrite two-phase structure at the high temperature carburizing and consequently for the realization of uniformly fine grain size. The minimum content of C is set at 0.03% because the required mechanical strength and the aforementioned two-phase structure at the high temperature are hardly attained when the C content is less than 0.03%. On the other hand, the content of C is limited to a maximum of 0.2% because the presence of more than 0.2% of C is liable to deteriorate the toughness and cold forgeability of the steel and, besides, offers difficulty in realizing the desired two-phase structure at the high temperature carburizing.

(2) Silicon

Si serves as a deoxidizer. Moreover, in a case hardening steel according to the invention Si has the effect of ensuring the formation of an austenite-ferrite two-phase structure at the high temperature carburizing and consequently preventing the grain size in the core of the carburized steel body from coarsening. To actually obtain this effect the content of Si needs to be at least 1.0%. However, the maximum content of Si is set at 3.0% because a larger content of Si becomes a cause of deterioration of the toughness and cold forgeability of the steel.

(3) Manganese

Mn has deoxidizing and desulfurizing effects and, besides, contributes to the enhancement of the mechanical strength of the steel. The minimum content of Mn is set at 0.2% because the expected effects remain insufficient when the Mn content is smaller, and also because the surface hardness after the carburizing treatment remains insufficient when the Mn content is less than 0.2%. On the other hand, the content of Mn is limited to a maximum of 2.0% because a larger content of Mn becomes a cause of deterioration of the workability and machinability of the steel.

(4) Vanadium

In the present invention, V is an important alloying element which is effective for refining of the grain size in the hardened case produced by the high temperature carburizing treatment. To actually obtain this effect the content of V must be at least 0.05%. However, the maximum content of V is set at 0.5% because the presence of a larger amount of V offers difficulty in affording sufficient toughness to the steel.

(5) Nickel, Chromium, Molybdenum

Ni, Cr and Mo are optional alloying elements which are effective in improving the hardenability of the steel and consequently strengthening the matrix of the carburized steel. Any of these three kinds of elements may be employed singly, and it is also permissible to jointly use two or all of these three kinds of elements. In any case the content of Ni should be up to 2.0%; the content of Cr should be up to 2.0%; and the content of Mo should be up to 0.5%. If the Ni content is more than 2.0%, or the Cr content is more than 2.0%, or the Mo content is more than 0.5%, the steel will become inferior in toughness.

(6) Aluminum, Niobium, Tantalum, Titanium, Zirconium, Nitrogen

These six kinds of elements are effective in preventing coarsening of the austenite grain size at the high temperature carburizing treatment. These elements may optionally be introduced into a case hardening steel according to the invention either singly or in any combination insofar as the amounts of the respective elements are adequate as specified hereinbefore. The effect of these elements does not augment proportionally to the amount of each element. The effect on the prevention of coarsening of the grain size lowers, and the toughness of the steel tends to become insufficient, when more than 0.1% of Al, more than 0.5% of Nb and Ta (referring to the total of Nb and Ta, whether Nb and Ta are jointly used or only one of them is used), more than 0.3% of Ti and/or more than 0.1% of Zr is introduced into the case hardening steel. The introduction of more than 0.03% of N into the steel is detrimental to the soundness of the steel ingots by reason of appearance of blow holes.

There are some other elements which may optionally be added to the fundamental composition of a case hardening steel according to the invention. To improve weatherability, the steel may contain up to 5% of Cu. To improve machinability, the steel may contain up to 0.4% of Pb, up to 0.4% of Bi, up to 0.4% of Se, up to 0.01% of Ca, and/or up to 0.4% of S and up to 0.1% of Te on condition that the ratio Te/S is not smaller than 0.04.

In practice, a case hardening steel according to the invention will contain some inevitable impurities. In general such impurities are controlled as in conventional case hardening steels. As to Sn, Sb and As which are obstructive to carburizing, it is desirable to control such that the content of any of these three impurity elements in the steel is not more than 0.05%. It is also desirable to limit the maximum content of B to 0.0005% because the presence of a larger amount of B will possibly become a cause of coarsening of the austenite grain size at the high temperature carburizing treatment. It is also desirable to limit the maximum content of 0 to 0.0030% and to limit the maximum content of S to 0.02% with a view to improving the fatigue strength and cold forgeability of the steel.

The invention will further be illustrated by the following nonlimitative examples.

EXAMPLES 1-27

Table 1 shows the chemical compositions of twenty-seven kinds of case hardening steels prepared as Examples 1-27 of the invention and six kinds of case hardening steels not in accordance with the invention prepared as References 1-6 for comparison purpose.

Each of these steels was prepared by the usual process of melting and ingot casting, and shaped by forging into a cylindrical rod 32 mm in diameter. Normalizing of the forged steel rod was carried out by heating it at 925° C. for 1 hr and leaving the heated rod to air cooling. After that the steel rod was machined into a diameter of 25 mm. Every sample prepared in this manner was subjected to vacuum carburizing treatment under the same condition. In this carburizing treatment propane was used as the carburizing gas, and the steel samples were heated at 1050° C. for 1 hr and quenched into oil kept at 100° C. The pressures in the furnace were 100–150 Torr at the carburizing stage and 40–70 Torr at the diffusion stage.

After carburizing, average grain sizes of austenite and ferrite in the hardened case and also in the core were measured on each sample by a method generally in accordance with the austenite grain size test method for steels specified in JIS G 0551. The results are presented in Table 1.

TABLE 1

| | C | Si | Mn | V | Ni | Cr | Mo |
|---|---|---|---|---|---|---|---|
| (Limits) | (0.03–0.2) | (1.0–3.0) | (0.2–2.0) | (0.05–0.5) | (≦2.0) — | (≦2.0) — | (≦0.5) — |
| Ref. 1 | 0.09 | 1.50 | 0.62 | 0.04 | — | — | — |
| Ref. 2 | 0.07 | 0.50 | 0.51 | 0.20 | 0.10 | 0.49 | — |
| Ref. 3 | 0.30 | 3.0 | 0.49 | 0.18 | 0.07 | 0.54 | — |
| Ref. 4 | 0.10 | 2.0 | 0.74 | 0.03 | 0.06 | 0.98 | — |
| Ref. 5 | 0.25 | 1.85 | 0.78 | 0.22 | — | — | — |
| Ref. 6 | 0.12 | 0.65 | 0.85 | 0.16 | — | 0.84 | 0.35 |
| Ex. 1 | 0.05 | 1.76 | 0.85 | 0.42 | — | — | — |
| Ex. 2 | 0.16 | 2.50 | 0.90 | 0.08 | — | — | — |
| Ex. 3 | 0.12 | 2.00 | 1.04 | 0.09 | 0.75 | — | — |
| Ex. 4 | 0.05 | 2.16 | 0.86 | 0.32 | — | 1.24 | — |
| Ex. 5 | 0.04 | 1.45 | 0.75 | 0.25 | — | — | 0.38 |
| Ex. 6 | 0.09 | 1.95 | 0.75 | 0.08 | 0.11 | 0.96 | — |
| Ex. 7 | 0.11 | 1.98 | 0.73 | 0.30 | 0.09 | 0.95 | — |
| Ex. 8 | 0.07 | 1.50 | 0.76 | 0.45 | 0.12 | 1.02 | — |
| Ex. 9 | 0.06 | 2.05 | 0.50 | 0.21 | 0.70 | 0.81 | — |
| Ex. 10 | 0.05 | 1.45 | 0.85 | 0.30 | — | 0.85 | 0.20 |
| Ex. 11 | 0.07 | 2.02 | 0.75 | 0.30 | 0.13 | 0.80 | 0.18 |
| Ex. 12 | 0.16 | 2.51 | 0.85 | 0.24 | — | — | — |
| Ex. 13 | 0.15 | 2.88 | 0.74 | 0.06 | — | — | — |
| Ex. 14 | 0.08 | 2.84 | 0.89 | 0.32 | — | — | — |
| Ex. 15 | 0.12 | 3.00 | 0.80 | 0.26 | — | — | — |
| Ex. 16 | 0.07 | 2.75 | 0.71 | 0.09 | — | — | — |
| Ex. 17 | 0.09 | 2.21 | 0.72 | 0.09 | — | — | — |
| Ex. 18 | 0.03 | 1.35 | 0.81 | 0.18 | — | — | — |
| Ex. 19 | 0.10 | 2.14 | 0.74 | 0.16 | — | — | — |
| Ex. 20 | 0.04 | 1.63 | 0.87 | 0.07 | 1.10 | — | — |
| Ex. 21 | 0.03 | 1.46 | 0.86 | 0.12 | — | 0.86 | — |
| Ex. 22 | 0.09 | 2.50 | 0.72 | 0.08 | — | — | 0.34 |
| Ex. 23 | 0.09 | 2.10 | 0.76 | 0.15 | 0.08 | 1.01 | — |
| Ex. 24 | 0.07 | 1.82 | 0.74 | 0.15 | 0.09 | 1.00 | — |
| Ex. 25 | 0.08 | 1.90 | 0.74 | 0.16 | 0.05 | 0.98 | — |
| Ex. 26 | 0.06 | 2.00 | 0.72 | 0.14 | 0.07 | 0.97 | — |
| Ex. 27 | 0.07 | 1.92 | 0.77 | 0.16 | 0.09 | 1.05 | — |

| | Al | Nb + Ta | Ti | Zr | N | Grain size | Grain size |
|---|---|---|---|---|---|---|---|
| (Limits) | (≦0.1) — | (≦0.5) — | (≦0.3) — | (≦0.1) — | (≦0.03) — | Number in Case (≧6) | Number in Core (≧6) |
| Ref. 1 | — | — | — | — | — | 3.2 | 6.8 |
| Ref. 2 | — | — | — | — | — | 6.2 | 3.2 |
| Ref. 3 | — | — | — | — | — | 6.5 | 3.8 |
| Ref. 4 | — | — | — | — | — | 2.4 | 7.2 |
| Ref. 5 | 0.05 | Nb:0.32 | — | — | — | 6.4 | 3.4 |
| Ref. 6 | 0.06 | Nb:0.40 | — | — | — | 6.1 | 3.5 |
| Ex. 1 | — | — | — | — | — | 6.8 | 7.4 |
| Ex. 2 | — | — | — | — | — | 6.5 | 6.4 |
| Ex. 3 | — | — | — | — | — | 7.6 | 7.1 |
| Ex. 4 | — | — | — | — | — | 7.2 | 7.4 |
| Ex. 5 | — | — | — | — | — | 7.4 | 7.5 |
| Ex. 6 | — | — | — | — | — | 6.3 | 7.3 |
| Ex. 7 | — | — | — | — | — | 7.9 | 8.2 |
| Ex. 8 | — | — | — | — | — | 9.0 | 8.5 |
| Ex. 9 | — | — | — | — | — | 8.0 | 7.0 |
| Ex. 10 | — | — | — | — | — | 7.8 | 8.2 |
| Ex. 11 | — | — | — | — | — | 8.5 | 7.4 |
| Ex. 12 | 0.07 | — | — | — | — | 8.4 | 8.2 |
| Ex. 13 | — | Nb:0.22 | — | — | — | 7.6 | 8.9 |
| Ex. 14 | — | — | 0.15 | — | — | 8.0 | 7.8 |
| Ex. 15 | — | — | — | 0.08 | — | 8.0 | 7.6 |
| Ex. 16 | — | — | — | — | 0.011 | 7.8 | 8.4 |
| Ex. 17 | 0.09 | Nb:0.15 Ta:0.10 | — | — | — | 8.6 | 8.2 |
| Ex. 18 | — | — | — | 0.05 | 0.012 | 8.5 | 7.6 |
| Ex. 19 | 0.05 | Ta:0.25 | 0.11 | 0.06 | 0.010 | 8.0 | 7.8 |
| Ex. 20 | 0.06 | — | — | — | — | 7.6 | 7.7 |
| Ex. 21 | — | — | — | — | — | 7.0 | 7.6 |
| Ex. 22 | — | — | — | 0.06 | 0.010 | 8.2 | 8.2 |

TABLE 1-continued

| | | | | | | | |
|---|---|---|---|---|---|---|---|
| Ex. 23 | 0.04 | — | — | — | 0.012 | 8.0 | 7.9 |
| Ex. 24 | — | Nb:0.03 | — | — | — | 7.8 | 7.5 |
| Ex. 25 | — | — | 0.04 | — | — | 7.9 | 8.0 |
| Ex. 26 | — | — | — | 0.05 | — | 8.1 | 8.2 |
| Ex. 27 | 0.035 | Nb:0.02 | — | — | 0.010 | 7.8 | 8.3 |

As can be seen in Table 1, the case hardening steels of References 1–6 were outside the scope of the present invention in respect of the content of C, Si or V, and in every one of these steels the average grain size number of austenite and ferrite was considerably smaller than Number 6 either in the hardened case or in the core. Therefore, it is certain that during the high temperature vacuum carburizing of these samples coarsening of the grain size occurred in either the hardened case or the core of each sample.

In contrast, in the case hardening steels of Examples 1–27 of the invention the average grain size numbers of austenite and ferrite were larger than Number 6 in both the hardened case and the core of every sample. That is, in the samples of Examples 1–27 the grain size after the high temperature carburizing became remarkably and uniformly fine. By using these case hardening steels it is possible to produce structural machine parts such as shafts and gears which are excellent in toughness, wear resistance, fatigue strength and dimensional precision.

The case hardening steels of Examples 1–6, 10, 11 and 23–27 were subjected to the measurements of tensile strength and impact value. After ingot casting, each of these steels was shaped by forging into a cylindrical rod 32 mm in diameter, and the steel rod was normalized by heating at 925° C. for 1 hr and succeeding air cooling. After that the rod was machined into a diameter of 25 mm and subjected to a heat treatment process, which had the sequential steps of heating at 1050° C. for 1.5 hr, heating at 930° C. for 0.5 hr, oil quenching, heating at 170° C. of 1 hr and air cooling. Tensile test pieces (JIS No. 4, reduced size) and Charpy impact test pieces (JIS No. 3) were cut out of the heat-treated steel rods, and a tensile test and an impact test were made on these test pieces at room temperature. The results are shown in Table 2. The experimental data in Table 2 demonstrate excellence of case hardening steels according to the invention in both strength and toughness.

TABLE 2

| | Tensile Strength ($kgf/mm^2$) | Charpy Impact Value ($kgf \cdot m/cm^2$) |
|---|---|---|
| Ex. 1 | 77.4 | 6.88 |
| Ex. 2 | 81.1 | 6.15 |
| Ex. 3 | 87.2 | 7.90 |
| Ex. 4 | 86.9 | 7.21 |
| Ex. 5 | 89.0 | 11.5 |
| Ex. 6 | 84.9 | 7.84 |
| Ex. 10 | 93.1 | 12.1 |
| Ex. 11 | 92.3 | 9.96 |
| Ex. 23 | 85.5 | 6.97 |
| Ex. 24 | 84.9 | 7.23 |
| Ex. 25 | 86.4 | 7.87 |
| Ex. 26 | 84.8 | 7.80 |
| Ex. 27 | 85.0 | 7.71 |

EXAMPLES 28–31

Table 3 shows the chemical compositions of case hardening steels of Examples 28–31. These compositions can be regarded as four different modifications of the composition of Example 4 with the addition of at least one kind of machinability improving element.

The steels of Examples 4 and 28–31 were each forged and machined into cylindrical rods having a diameter of 50 mm, and the steel rods were normalized by heating at 925° C. for 2 hr and succeeding air cooling. Then, a number of holes were bored in the sample rods of each steel by consecutively using a single drill attached to a conventional drilling machine until drilling became impossible by wearing of the drill. This test was made for the purpose of evaluating the machinability of each steel from the total number of the holes which the single drill could bore in the sample rods. The drill material was a high-speed tool steel and the drill diameter was 10 mm. The holes bored in the steel rods were all 20 mm deep. The drilling was performed at a feed rate of 0.4 mm per revolution and at a cutting speed of 50 m/min without using any cutting fluid. The results of this test are presented in Table 3.

As can be seen in Table 3, the addition of the machinability improving element(s), S, Pb and/or Te, to the steel composition of Example 4 actually produced a remarkable improvement on the machinability.

TABLE 3

| | C | Si | Mn | V | Cr | Other(s) | Number of Drilled Holes |
|---|---|---|---|---|---|---|---|
| Ex. 4 | 0.05 | 2.16 | 0.86 | 0.32 | 1.24 | — | 11 |
| Ex. 28 | 0.05 | 2.07 | 0.87 | 0.31 | 1.10 | S:0.056 | 48 |
| Ex. 29 | 0.06 | 2.00 | 0.75 | 0.28 | 1.13 | Pb:0.15 | 103 |
| Ex. 30 | 0.05 | 2.03 | 0.80 | 0.24 | 1.08 | S:0.050<br>Pb:0.13 | 256 |
| Ex. 31 | 0.04 | 2.01 | 0.81 | 0.27 | 1.09 | S:0.054<br>Pb:0.10<br>Te:0.005 | 355 |

EXAMPLE 32

As Example 32, the steel composition of Example 1 was modified by the addition of Cu which is a weatherability improving element, as shown in Table 4.

The case hardening steels of Examples 1 and 32 were each forged and machined into a cylindrical rod 25 mm in diameter and 75 mm in length, and the steel rods were carburized under the same conditions as in Examples 1–27. In a degreased state the carburized steel rods were left exposed to the atmosphere for 96 hr. The degrees of rusting of the two kinds of steel rods were as noted in Table 4. That is, the Cu-containing steel of Example 32 exhibited considerably improved weatherability compared with the steel of Example 1.

TABLE 4

| | C | Si | Mn | V | Cu | Weatherability |
|---|---|---|---|---|---|---|
| Ex. 1 | 0.05 | 1.76 | 0.85 | 0.42 | — | rust appeared in entire surface area |
| Ex. 32 | 0.04 | 1.80 | 0.82 | 0.38 | 1.3 | rust appeared in about a half of entire surface area |

In additional experiments on the steel compositions according to the invention, it was confirmed that selective addition of an adequate amount of Bi, Se and/or Ca produces a desired effect without adversely affecting the fundamental properties of the carburized steel, and that strict control of specific impurity elements such as 0, S, Sn, Sb and As is actually effective.

What is claimed is:

1. A method for making a carburized steel part having a case region, comprising the steps of:

(a) preparing a steel part consisting essentially of 0.03 to 0.2 wt. % C, 1 to 3 wt. % Si, 0.2 to 2 wt. % Mn, 0.05 to 0.5 wt. % V, with the balance consisting essentially of Fe; and (b) carburizing the steel part at a temperature about 950° C.;

wherein after the carburizing step the steel part comprises a two-phase structure of austenite and ferrite and wherein the grain structure of the steel part comprises a grain size in every region of greater than or equal to ASTM Number 6.

2. A method as claimed in claim 1, wherein after the carburizing step the steel part is quenched.

* * * * *